US006446483B1

(12) United States Patent
Ericksen

(10) Patent No.: US 6,446,483 B1
(45) Date of Patent: Sep. 10, 2002

(54) BENDING TOOL AND METHOD FOR PIPES OF DIFFERING WIDTHS

(76) Inventor: Mark A. Ericksen, 1835 Industrial Blvd., Suite C, Norman, OK (US) 73069

( * ) Notice: Subject to any disclaimer, the term of this patent is extended or adjusted under 35 U.S.C. 154(b) by 0 days.

(21) Appl. No.: 09/844,648

(22) Filed: Apr. 27, 2001

(51) Int. Cl.[7] ..... B21D 7/14
(52) U.S. Cl. ..... 72/459
(58) Field of Search ..... 72/458, 459, 457, 72/31.04

(56) References Cited

U.S. PATENT DOCUMENTS 1,659,026 A 2/1928 Henderson
2,233,292 A * 2/1941 Lewin ..... 72/459
2,381,064 A * 8/1945 Lewin ..... 72/459
2,584,537 A 2/1952 Benfield
2,817,986 A 12/1957 Benfield
4,269,056 A * 5/1981 Kozinski ..... 72/459
4,442,695 A 4/1984 Gardner
4,452,064 A * 6/1984 Custin ..... 72/459

* cited by examiner

*Primary Examiner*—David Jones
(74) *Attorney, Agent, or Firm*—Gary Peterson

(57) ABSTRACT

A pipe bending tool is formed from a body and a pipe engaging hook. The body features a curved and convex base in which a longitudinal channel is formed. The channel features a first section, characterized by planar and preferably parallel side walls, and a deeper and adjacent second section, characterized by planar side walls, which preferably taper. The side walls of the second section preferably converge at a 90° angle to form a V-shaped channel base. This channel design permits pipes of more than one diameter to be bent in the same tool.

11 Claims, 3 Drawing Sheets

BENDING TOOL AND METHOD FOR PIPES OF DIFFERING WIDTHS

FIELD OF THE INVENTION

The invention relates to tools and methods for bending pipes, such as electrical conduits.

SUMMARY OF THE INVENTION

The present invention comprises a pipe bending tool formed from a body having a curved convex base. A longitudinal channel is formed in the surface of the base, and extends between a first end and a second end. The channel features a first section, defined by a pair of planar first side walls, and an adjacent second section, defined by a pair of planar second side walls having a minimum separation distance which is less than the minimum separation distance of the first side walls. The tool further comprises a pipe-engaging hook supported by the body adjacent the first end of the channel.

The tool may be used in a method for bending a first pipe and a second pipe, with the second pipe having a maximum width which is less than the maximum width of the first pipe. The tool used in this method features first side walls having maximum and minimum separation distances which permit a cross-section of the first pipe to concurrently contact each of the first side walls, and second side walls having a maximum separation distance greater than the maximum width of the second pipe. One end of the first pipe is inserted into the tool, such that it extends within the channel at its first end, and is engaged by the hook. The assembled first pipe and tool are positioned on a supporting surface such that the base of the tool rollably engages the supporting surface, and such that the hook of the tool is immediately adjacent the supporting surface. The base of the tool is rocked on the supporting surface so as to raise the hook and bend the first pipe within the channel. The bent first pipe is then removed from the tool.

One end of the second pipe is inserted into the tool, such that it extends within the second section of channel at its first end, and is engaged by the hook. The assembled second pipe and tool are positioned on a supporting surface such that the base of the tool rollably engages the supporting surface, and such that the hook of the tool is immediately adjacent the supporting surface. The base of the tool is rocked on the supporting surface so as to raise the hook and bend the second pipe within the channel. The bent second pipe is then removed from the tool.

DETAILED DESCRIPTION

Figure 1:
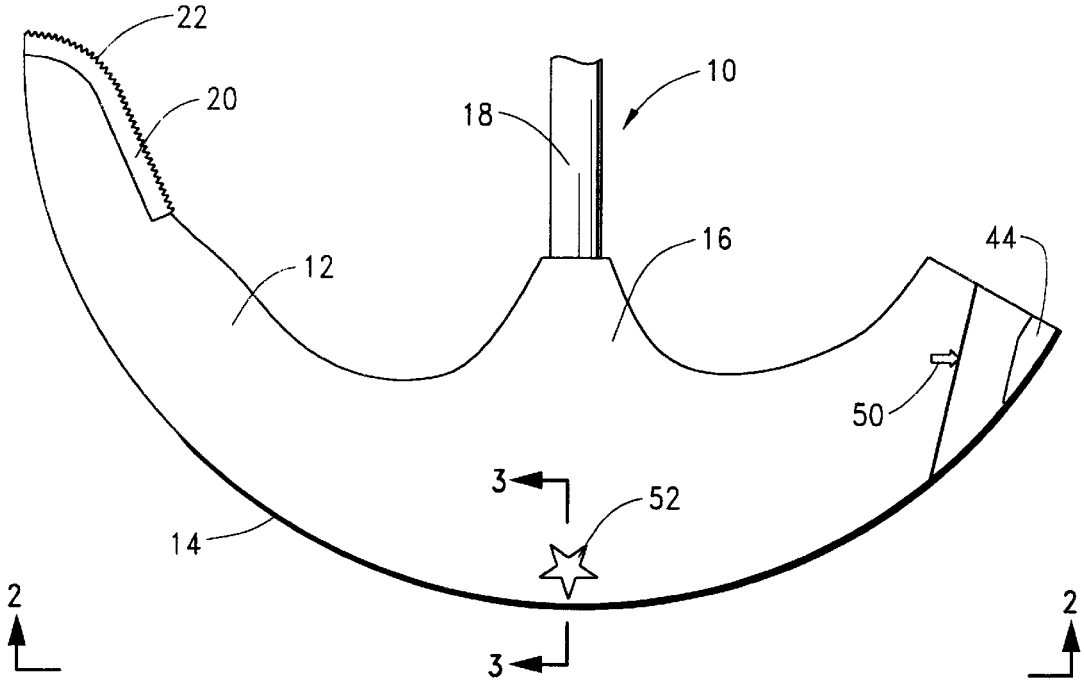
FIG. 1 is a side elevational view of the pipe bending tool of the present invention.
Figure 2:
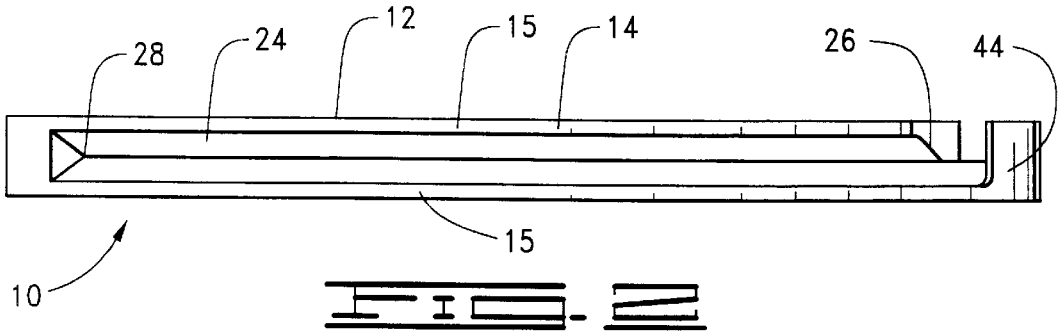
FIG. 2 is a bottom view of the pipe bending tool of the present invention, taken along the line 2—2 shown in FIG. 1.
Figure 3:
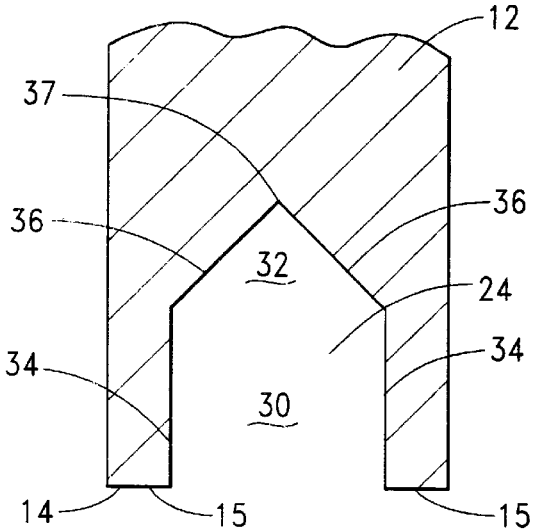
FIG. 3 is a partial cross-sectional view of the pipe bending tool of the present invention, taken along the line 3-3 shown in FIG. 1.

With reference to FIGS. 1–3, the pipe bending tool of the present invention, generally designated by reference numeral 10, comprises a crescent-shaped body 12 formed from a durable material such as cast iron or aluminum. In the embodiment shown in FIGS. 1–3, the body 12 is characterized by the solid structure shown in FIG. 1; alternately, the body may have a more open, web-like structure, such as that disclosed in U.S. Pat. No. 2,584,537, the entire disclosure of which is incorporated by reference.

The body 12 is characterized by a curved and convex base 14 having a surface 15. The curve defined by the base 14 is preferably characterized by a single, uniform radius of curvature, so that the surface 15 of the base 14 coincides with the arc of a circle. The body 12 should be formed so that the central angle which includes the curve defined by the base 14 is approximately equal to the angle of the bend to be formed by the tool 10. The tool shown in the Figures forms bends of 90°; the included angle defined by the curve of the base 14 is accordingly about 90°. In tools which form bends of other angles, such as 45° and 22.5°, the central angle which includes the curved defined by the base will vary in accordance with the bend angle.

As best shown in FIG. 1, the body 12 includes a socket portion 16 adjacent the medial portion of the curve defined by the base 14. Formed within the socket portion 16 is a socket (not shown) which opens toward the center of curvature of the base 12. Preferably, the socket is characterized by a longitudinal axis which coincides with the radius of curvature of that portion of the base 12 immediately adjacent the socket. The socket preferably includes internal threads, and is characterized by a cylindrical shape and a substantially circular cross section. An elongate handle 18, preferably of circular cross-section and having external threads which mate with the internal threads of the socket, is threadingly received and secured within the socket. The handle 18 may be formed from wood or some other sturdy material.

With continued reference to FIG. 1, a pedal 20 is formed in the body 12 adjacent the second end 28 of the channel 24, between the base 14 and its center of curvature. The pedal 20 faces the center of curvature of the base 12, and is sized to receive and engage the sole of a foot of a human user of the tool 10. The pedal 20 is preferably provided with a serrated surface 22, in order to stabilize the user's foothold.

As best shown in FIGS. 2 and 3, a longitudinal channel 24, having a first end 26 and a second end 28, is formed in the surface 15 of the base 14. The channel 24 opens at the surface 15 into a first section 30 which adjoins and communicates with a deeper second section 32. The first section 30 is defined by a pair of spaced planar first side walls 34. Preferably, the first side walls 34 are parallel, so that their maximum separation distance equals their minimum separation distance.

The second section 32 is defined by at least a pair of planar second side walls 36. The second side walls 36 have a minimum separation distance, and which is less than the minimum separation distance of the first side walls 34. Preferably, the second side walls 36 are not parallel. Also preferably, each planar second side wall 36 of the second section 32 adjoins a respective planar first side wall 34 of the first section 30.

Preferably, the second side walls 34 taper toward each other, such that their separation distance decreases as their depth within the channel 24 increases. Also preferably, the second side walls 36 converge to form a V-shaped channel base 37. Whether or not the second side walls 36 so converge, however, it is preferred that the planes which coincide with the second side walls 36 intersect at an included angle of about 90°.

Figure 5:
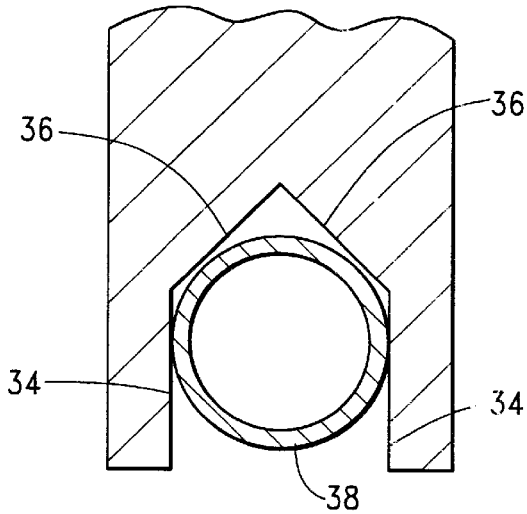
FIG. 5 is a partial cross-sectional view of the pipe bending tool of the present invention, similar to the view shown FIG. 3, showing the disposition of a first pipe in the longitudinal channel of the tool.
Figure 4:
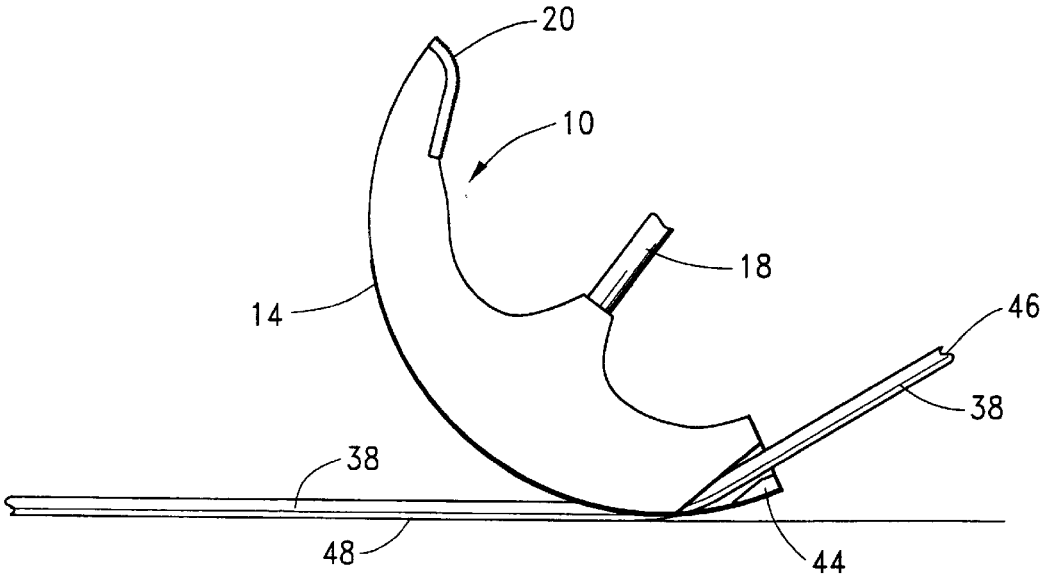
FIG. 4 is a side elevational of the pipe bending tool of the present invention, in the process of bending a pipe.

As shown in FIGS. 4 and 5, the channel is sized, by selection of maximum and minimum separation distances of the first side walls 34, such that a cross-section of the widest pipe to be bent with the tool 10 can be received in the channel 24, and positioned in concurrent contact with each of the first side walls 34. This separation distance assures that each of the first side walls 34 can grippingly engage such a pipe at the point of bending. Preferably, the first side walls 34 contact the cross-section at or near its region of greatest width.

When the first side walls 34 are parallel, the separation distance of the first side walls 34 should be a minimal clearing distance in excess of the maximum cross-sectional width of the widest pipe to be bent with the tool 10. Thus, when the tool 10 is to be used to bend a pipe having a circular cross-section, such as the first pipe 38 shown in FIG. 5, the separation distance of the parallel first side walls 34 should be about a minimal clearing distance in excess of the diameter of the first pipe 38.

The channel 24 is further, by appropriate selection of the depths of the first section 30, second section 32, and the included angle between the side walls, so that a cross-section of the widest pipe to be bent with the tool 10 can be positioned within the channel 24 without projection beyond the surface 15 of the base 14. This sizing of the channel 24 assures that such a pipe, as well as a pipe of lesser maximum width, can fully reside within the channel 24 at the point of bending. Such positioning protects the pipe from unwanted cross-sectional deformation by the supporting surface which is used during the bending process.

In particular, when the pipe to be bent with the tool 10 is characterized by a circular cross-section, as shown in the Figures, the channel 24 is sized and angled so that a circular cross-section of largest diameter pipe to be bent with the tool 10 can fully reside within the channel 24, without projection beyond the surface of the base 14.

The design of the channel 24 permits pipes of more than one width to be bent with the same tool 10. As shown in FIG. 5, when a first pipe 38 is received within the channel 24, it resides primarily within the first section 30, and is engaged by at least the first side walls 34, and possibly the second side walls 36, at the point of bending.

Figure 6:
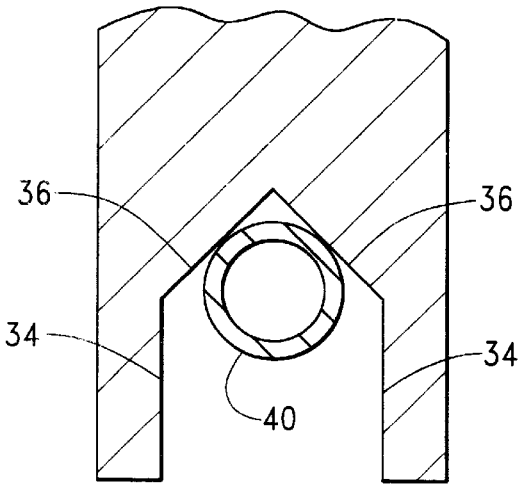
FIG. 6 is a partial cross-sectional view of the pipe bending tool of the present invention, showing the disposition of a second pipe, having a maximum width less than that of the first pipe, in the longitudinal channel of the tool.
Figure 7:
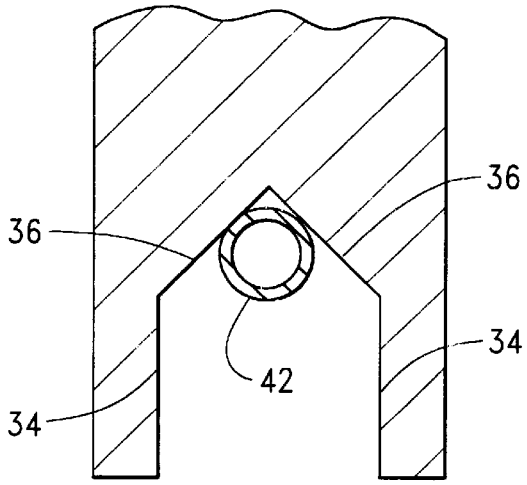
FIG. 7 is a partial cross-sectional view of the pipe bending tool of the present invention, showing the disposition of a third pipe, having a maximum width less than that of the first and second pipes, in the longitudinal channel of the tool.

FIG. 6 shows a second pipe 40, which has a maximum width both less than that of the first pipe 38 and less than the maximum separation distance of the second side walls 36. When such a second pipe 40 is positioned within the channel 24, it is bendingly engaged by the second side walls 36, and resides primarily within the second section 32 at the point of bending. As shown in FIG. 7, when a third pipe 42 having a maximum width less than that of the second pipe 40 is positioned within the channel 24, it is likewise bendingly engaged by the second side walls 36, and likewise resides primarily, if not exclusively, within the second section 32 at the point of bending. The first side walls 34 do not bendingly engage either the second pipe 40 or the third pipe 42.

Thus, for example, when conduit of circular cross section is to be bent with the tool 10, and when the tool 10 is provided parallel first side walls 34 having a separation distance which is a minimal clearing distance in excess of 1 inch, the tool 10 can be used to bend 1 inch diameter conduit, and ¾inch and ½ inch diameter conduit as well. These lesser diameter conduits are bent while engaged by the second side walls 36, as described above. The two points of support provided by the second side walls 36 permit bending of smaller pipes, such as the pipes shown in FIGS. 6 and 7, without substantial cross-sectional deformation.

With reference to FIGS. 1 and 2, the tool 10 further comprises a pipe-engaging hook 44 supported by the body 12 adjacent the first end 26 of the channel 24. The hook 44 is preferably integral with the body 12, and formed from the same material as the body 12. The hook 44 is positioned in opposition to the channel 24, so that it can engage the upper surface of a pipe having lower surfaces which are in bending engagement with the side walls of the channel 24.

As shown in FIG. 1, the hook may be provided with a first indicator 50, such as an arrow, notch or other marking, which can be used as a base mark for locating a bend. A second indicator 52, such as a star, notch or other marking, may be provided on either or both sides of the exterior face of the body 12, adjacent the curved base 14, at a point which corresponds to the point of bending produced by the tool, in order to place a bend at a desired point in a pipe.

The tool 10 may be used in a method of bending a single pipe or a series of pipes having the same or different maximum widths. If a series of pipes of different maximum widths is bent in the method, they may be bent in any order. The pipes used in the method may comprise electrical conduit or any other type of pipe or conduit which requires bending.

With reference to FIG. 4, a first pipe 38 is inserted. at one of its ends 44 into the tool 10, such that the first pipe 38 extends within the channel 24 adjacent its first end 26, and is engaged by the hook 44. The maximum and minimum separation distances of the first side walls 34 permit a cross-section of the first 38 pipe to concurrently contact each of the first side walls 34. Thus, as shown in FIG. 5, the first pipe 38 can fully reside within the channel 24 at the point of bending, without projection beyond the surface 15, and is bendingly engaged by each of the first side walls 34.

As shown in FIG. 4, the assembled first pipe 38 and tool 10 are positioned on a supporting surface 48, such as a floor, such that the base 14 rollably engages the supporting surface 48, and such that the hook 44 is immediately adjacent the supporting surface. After grasping the handle 18, and preferably positioning a foot on the pedal 20, the user rocks the base 14 on the supporting surface 48, so as to raise the hook 44 and bend the first pipe 38 within the channel 24 to the desired angle. The bent first pipe 38 may then be removed from the tool 10.

In order to bend a second pipe 40 having a maximum width less than that of the first pipe 38, one end of the second pipe 40 is inserted into the tool 10. Because the second side walls 36 have a maximum separation distance greater than the maximum width of the second pipe 40, the second pipe 40 extends within the second section 32 of the channel 24 at its first end 26, and is engaged by the hook 44. As shown in FIG. 6, the second pipe 40 can fully reside within the channel 24 at the point of bending,. and is bendingly engaged by the second side walls 36.

Much as with the first pipe 38, the assembled second pipe and tool are positioned on a supporting surface, such that the base rollably engages the supporting surface, and such that the hook is immediately adjacent the supporting surface. The user rocks the base on the supporting surface, so as to raise the hook and bend the second pipe within the channel to the desired angle. The bent second pipe may then be removed from the tool.

A third pipe having a maximum width which is less than the maximum width of the first pipe and not equal to the maximum width of the second pipe, such as the third pipe 42 shown in FIG. 7, may also be bent. If the maximum separation distance of the second side walls 36 is greater than the maximum width of the third pipe, as is shown in FIG. 7, the bending is carried out by the following the same steps with the third pipe which are described above for the bending of the second pipe.

Changes may be made in the construction, operation and arrangement of the various parts, elements, steps and procedures described herein without departing from the spirit and scope of the invention as defined in the following claims.

What is claimed is:

1. A pipe bending tool, comprising:

a body having a curved convex base, the base having a surface within which a longitudinal channel is formed, the channel extending between a first end and a second end and having a first section defined by a pair of planar first side walls, and an adjacent second section defined by a pair of second planar non-parallel side walls having a minimum separation distance which is less than the minimum separation distance of the first side walls, and in which the planes which coincide with the second side walls intersect at an included angle of about 90°; and a pipe-engaging hook supported by the body adjacent the first end of the channel.

2. The tool of claim 1 in which the second side walls converge to form a V-shaped channel base.

3. The tool of claim 1 in which the channel is sized so that a cross-section of the widest pipe to be bent with the tool can be positioned within the channel in concurrent contact with each of the first side walls, without projection beyond the surface of the base.

4. The tool of claim 1 in which the first side walls are parallel.

5. The tool of claim 4 in which the second side walls converge to form a V-shaped channel base.

6. The tool of claim 4 in which the channel is sized so that a cross-section of the widest pipe to be bent with the tool can be positioned within the channel in concurrent contact with each of the first side walls, without projection beyond the surface of the base.

7. A method of bending plural pipes, including at least a first pipe, a second pipe having a maximum width less than that of the first pipe and a third pipe having a maximum width which is less than the maximum width of the first pipe and not equal to the maximum width of the second pipe, comprising:

inserting one end of the first pipe into a tool having a body having a curved convex base, the base having a longitudinal channel extending between a first end and a second end, the channel having a first section defined by a pair of planar first side walls having maximum and minimum separation distances which permit a cross-section of the first pipe to concurrently contact each of the first side walls, and an adjacent second section defined by planar second side walls having a minimum separation distance less than the minimum separation distance of the first side walls and a maximum separation distance greater than the maximum widths of both the second and third pipes, and a pipe-engaging hook supported by the body adjacent the first end of the channel, such that the first pipe extends within the channel at its first end, and is engaged by the hook;

positioning the assembled first pipe and tool on a supporting surface such that the base of the tool rollably engages the supporting surface, and such that the hook of the tool is immediately adjacent the supporting surface;

rocking the base of the tool on the supporting surface so as to raise the hook and bend the first pipe within the channel;

removing the bent first pipe from the tool;

inserting one end of the second pipe into the tool, such that the second pipe extends within the second section of the channel at its first end, and is engaged by the hook;

positioning the assembled second pipe and tool on a supporting surface such that the base of the tool rollably engages the supporting surface, and such that the hook of the tool is immediately adjacent the supporting surface;

rocking the base of the tool on the supporting surface so as to raise the hook and bend the second pipe within the channel;

removing the bent second pipe from the tool;

inserting one end of the third pipe into the tool, such that the third pipe extends within the second section of the channel at its first end, and is engaged by the hook;

positioning the assembled third pipe and tool on a supporting surface such that the base of the tool rollably engages the supporting surface, and such that the hook of the tool is immediately adjacent the supporting surface;

rocking the base of the tool on the supporting surface so as to raise the hook and bend the third pipe within the channel; and removing the bent third pipe from the tool.

8. A pipe bending tool, comprising:

a body having a curved convex base, the base having a surface within which a longitudinal channel is formed, the channel extending between a first end and a second end and having a first section defined by a pair of planar first side walls, and an adjacent second section defined by a pair of second planar non-parallel side walls having a minimum separation distance which is less than the minimum separation distance of the first side walls, in which the second side walls converge to form a V-shaped channel base;

a pipe-engaging hook supported by the body adjacent the first end of the channel.

9. The tool of claim 8 in which the channel is sized so that a cross-section of the widest pipe to be bent with the tool can be positioned within the channel in concurrent contact with each of the first side walls, without projection beyond the surface of the base.

10. The tool of claim 8 in which the first side walls are parallel.

11. The tool of claim 10 in which the channel is sized so that a cross-section of the widest pipe to be bent with the tool can be positioned within the channel in concurrent contact with each of the first side walls, without projection beyond the surface of the base.

* * * * *